US008063009B2

(12) United States Patent
Onoda et al.

(10) Patent No.: US 8,063,009 B2
(45) Date of Patent: Nov. 22, 2011

(54) BLEACHING ACTIVATOR GRANULE

(75) Inventors: Keiichi Onoda, Wakayama (JP); Masakazu Furukawa, Wakayama (JP); Kazuyoshi Ozaki, Wakayama (JP); Hiroshi Noro, Wakayama (JP); Yasumitsu Sakuma, Wakayama (JP)

(73) Assignee: Kao Corporation, Tokyo (JP)

( * ) Notice: Subject to any disclaimer, the term of this patent is extended or adjusted under 35 U.S.C. 154(b) by 180 days.

(21) Appl. No.: 12/085,997

(22) PCT Filed: Jan. 24, 2007

(86) PCT No.: PCT/JP2007/051531

§ 371 (c)(1),
(2), (4) Date: Jun. 4, 2008

(87) PCT Pub. No.: WO2007/086588

PCT Pub. Date: Aug. 2, 2007

(65) Prior Publication Data

US 2009/0281018 A1 Nov. 12, 2009

(30) Foreign Application Priority Data

Jan. 25, 2006 (JP) ..... 2006-016336
May 17, 2006 (JP) ..... 2006-137445

(51) Int. Cl.

| | |
|---|---|
| ***C11D 1/72*** | (2006.01) |
| ***C11D 1/722*** | (2006.01) |
| ***C11D 3/39*** | (2006.01) |
| ***C11D 3/395*** | (2006.01) |
| ***C11D 3/43*** | (2006.01) |

(52) U.S. Cl. ..... 510/310; 510/356; 510/376; 510/443; 510/444; 510/505; 510/506

(58) Field of Classification Search ..... 510/310, 510/356, 376, 443, 444, 505, 506
See application file for complete search history.

(56) References Cited

U.S. PATENT DOCUMENTS

| | | | | |
|---|---|---|---|---|
| 4,134,725 | A * | 1/1979 | Buchel et al. | 8/526 |
| 4,399,049 | A | 8/1983 | Gray et al. | |
| 4,486,327 | A * | 12/1984 | Murphy et al. | 510/376 |
| 4,678,594 | A * | 7/1987 | Parfomak et al. | 252/186.31 |
| 4,921,631 | A * | 5/1990 | Gradwell et al. | 252/186.38 |
| 5,002,691 | A * | 3/1991 | Bolkan et al. | 252/186.25 |
| 5,055,217 | A | 10/1991 | Garcia et al. | |
| 5,431,857 | A * | 7/1995 | Capeci | 510/352 |
| 5,540,855 | A * | 7/1996 | Baillely et al. | 510/276 |
| 6,500,794 | B1 | 12/2002 | Yamaguchi et al. | |
| 6,974,789 | B1 * | 12/2005 | Whitaker et al. | 510/294 |
| 2002/0160930 | A1 * | 10/2002 | Emmerson et al. | 510/445 |
| 2003/0017956 | A1 * | 1/2003 | Preissner et al. | 510/311 |
| 2006/0293204 | A1 * | 12/2006 | Kaneda et al. | 510/376 |

FOREIGN PATENT DOCUMENTS

| | | | |
|---|---|---|---|
| EP | 0429108 | A2 | 5/1991 |
| EP | 1046702 | A2 | 10/2000 |
| JP | 02-255800 | A | 10/1990 |
| JP | 05-440 | B2 | 1/1993 |
| JP | 06-145695 | A | 5/1994 |
| JP | 2001-059099 | A | 3/2001 |

OTHER PUBLICATIONS

Material Safety Data Sheet—Polyethylene glycol 600, p. 1-6, Oct. 10, 2005.*
Supplementary European Search Report for application No. EP07707749.3, mailed Dec. 18, 2009.
Chinese Application No. 2007/80003608.8, Office Action, Sep. 20, 2010, 4 pages.

* cited by examiner

*Primary Examiner* — Gregory Delcotto
(74) *Attorney, Agent, or Firm* — Birch, Stewart, Kolasch & Birch, LLP

(57) ABSTRACT

The present invention relates to a bleaching activator granule containing (a) a bleaching activator and (b) a specified alcohol which is liquid at room temperature (25° C.).

16 Claims, 1 Drawing Sheet

BLEACHING ACTIVATOR GRANULE

FIELD OF THE INVENTION

The present invention relates to a bleaching activator granule. More particularly, the present invention relates to a bleaching activator granule that is improved in solubility and has high bleaching ability.

BACKGROUND OF THE INVENTION

Sodium percarbonate and sodium perborate are currently used primarily as bleaching base agents in bleaching agents and bleaching detergents. However, because only insufficient bleaching performance is obtained by only these base agents, bleaching activators such as TAED (tetraacetylethylenediamine) and AOBS (sodium alkanoyloxybenzenesulfonate) have come to be used together. These bleaching activators react with hydrogen peroxide generated from peroxides such as sodium percarbonate to generate an organic peracid having high bleachability, producing an effect on bleaching of clothes. The bleaching activator is mixed with a surfactant, a binder and the like and the mixture is then granulated and then the granule is formulated and used in detergents for clothes depending on the situation. It is so devised that such bleaching activator granules are improved in solubility as described in, for example, JP-B5-440.

SUMMARY OF THE INVENTION

The present invention relates to a bleaching activator granule containing a component (a): a bleaching activator and a component (b): one or more compounds which are liquid at room temperature (25° C.) and are selected from a polyhydric alcohol and compounds represented by the following formula (I):

$$R—O-[(EO)_a/(PO)_b]-H \quad (I)$$

wherein R represents a hydrocarbon group having 1 to 8 carbon atoms, EO represents an ethyleneoxy group and PO represents a propyleneoxy group, and a and b are each an average addition molar number and each denote a number from 0 to 10, provided that a and b are not 0 simultaneously, and also to a bleaching agent composition containing the bleaching activator granule and an inorganic peroxide.

The present invention also relates to a method of producing a bleaching activator granule containing a component (a): a bleaching activator, a component (b): one or more compounds which are liquid at room temperature (25° C.) and are selected from a polyhydric alcohol and compounds represented by the above formula (I), and a component (c): a nonionic surfactant and/or a component (d) a binder material, the method including a process of mixing a liquid product containing the component (b) with the component (a).

The present invention relates to a bleaching activation use of the above granule or a granule obtained in the above production method.

DETAILED DESCRIPTION OF THE INVENTION

In the above conventional method, a bleaching activator granule has a low dissolution rate in a condition using cool water and therefore, the function of a bleaching activator can be insufficiently developed though it dissolves at a relatively high rate in a washing condition using hot water.

Also, there is the case of formulating a surfactant which is liquid at room temperature (25° C.) to raise the rate of dissolution of a bleaching activator granule. However, if a surfactant is formulated in a large amount to improve the dissolution ability of the surfactant, there is the case where the properties, such as caking characteristics, of the bleaching activator granule are deteriorated.

Earnest studies have been made to develop a higher bleaching performance as mentioned above. However, the development has been made insufficiently and it has been therefore desired to develop a bleaching activator granule improved in solubility. At this time, it is desired to improve the solubility while satisfying the requirements as to the properties such as caking characteristics.

The inventors of the present invention have made earnest studies to solve the above problem and as a result, found that when a specified compound which is liquid at room temperature (25° C.) is formulated in a bleaching activator granule, the solubility of the bleaching activator granule is improved, with the result that the rate of generation of organic peracids is improved and the bleaching performance is also improved.

The inventors have also found that a higher effect is obtained by allowing a specified compound which is liquid at room temperature (25° C.), to coexist with a nonionic surfactant. The inventors have also found that this makes it possible to limit the total compounding amount of the nonionic surfactant and the specified compound which is liquid at room temperature (25° C.) to a smaller level, with the result that the solubility is improved while satisfying the requirements as to properties such as caking characteristics.

According to the present invention, a bleaching activator granule superior in solubility is obtained. Moreover, when a nonionic surfactant is used together, the solubility can be improved while satisfying the requirements as to properties such as caking characteristics. The bleaching performance of a bleaching agent composition and a bleaching detergent composition can be improved by compounding the bleaching activator granule of the present invention.

The components used in the bleaching activator granule of the present invention will be explained.

<Component (a)>

The bleaching activator granule of the present invention contains a bleaching activator as the component (a). In this specification, the bleaching activator means a compound which reacts with an inorganic peroxide to thereby generate an organic peracid. Examples of the bleaching activator include compounds having an ester bond and represented by the following formula (1).

$$R^{1a}—C(=O)-LG \quad (1)$$

In the formula, $R^{1a}$ represents a hydrocarbon group having 8 to 14 carbon atoms, preferably a straight-chain or branched alkyl group, alkenyl group, aryl group or alkyl group-substituted aryl group and more preferably a straight-chain or branched alkyl group having 10 to 14 carbon atoms and LG represents a leaving group.

Examples of the leaving group LG include groups represented by the following formulae:

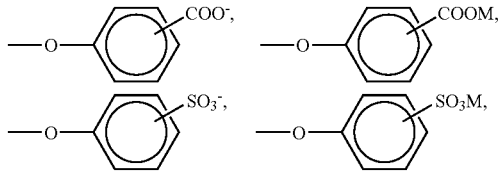

and —O—$R^{2a}$—$(O)_p$—$SO_3^-$ and —O—$R^{2a}$—$(O)_p$—$SO_3M$ (where $R^{2a}$ represents an alkylene group, p denotes 0 or 1 and M represents a hydrogen atom or an alkali metal). The alkylene group represented by $R^{2a}$ preferably has 1 to 5 carbon atoms.

The bleaching activator in the present invention is not limited to compounds represented by the formula (1) and conventional bleaching activators which are usually used may be used. Examples of the bleaching activator include tetraacetylethylenediamine, glucose pentaacetate, tetraacetyl glycol uryl, alkanoyl or alkenoyl (the number of carbons in these groups is 8 to 14) oxybenzenecarboxylic acid or its salt and alkanoyl or alkenoyl (the number of carbons in these groups is 8 to 14) oxybenzenesulfonate or its salt. Among these compounds, one or more types selected from alkanoyl or alkenoyl (the number of carbons in these groups is 8 to 14 and preferably 10 to 14 from the viewpoint of a bleaching effect) oxybenzenecarboxylic acid or its salt and alkanoyl or alkenoyl (the number of carbons in these groups is 8 to 14 and preferably 10 to 14 from the viewpoint of a bleaching effect) oxybenzenesulfonate or its salt. These bleaching activators may be used either singly or in combinations of two or more. Particularly, decanoyloxybenzenecarboxylic acid or its sodium salt and sodium dodecanoyloxybenzenesulfonate are preferable.

Also, these compounds are preferably used in the form of a powder. In this case, the apparent density of the bleaching activator is preferably 0.3 to 0.7 g/ml and more preferably 0.35 to 0.6 g/ml. Also, the average particle diameter of the particle is preferably 0.5 to 200 μm and more preferably 2 to 100 μm from the viewpoint of granulating characteristics and solubility.

The particle diameter may be measured in acetone by using a laser diffraction/diffusing type grain distribution-measuring device (Microtrack HRA, manufactured by Nikkiso Co., Ltd.). The content of the component (a) in the bleaching activator granule is preferably 10 to 95% by weight from the viewpoint of bleaching performance and more preferably 50 to 90% by weight from the viewpoint of solubility.

<Component (b)>

The bleaching activator granule of the present invention contains, as the component (b), one or more types of compounds which are selected from polyhydric alcohols and compounds represented by the above formula (I) and are liquid at room temperature (25° C.). For example, the component (b) contains a compound selected from straight-chain or branched polyhydric alcohols having 2 to 12, preferably 2 to 9 and more preferably 2 to 6 carbon atoms.

Although no particular limitation is imposed on the compound which is a polyhydric alcohol and is liquid at room temperature (25° C.), examples of the compound include glycerin, ethylene glycol, propylene glycol and 1,2,6-hexanetriol from the viewpoint of solubility and the properties of the granule. Among these compounds, glycerin, ethylene glycol and propylene glycol are preferable and glycerin is more preferable. These polyhydric alcohols may be used arbitrarily either singly or in combinations of two or more. Moreover, these polyhydric alcohols may be used by diluting each with water or the like from the viewpoint of production.

Also, the compound represented by the above formula (I) is a type of alcohol and no particular limitation is imposed on the compound. However, in the formula (I), the number of carbons in R is preferably 2 to 5, a is preferably to 5 and more preferably 0 to 3, and b is preferably 0 to 5 and more preferably 0 to 3 from the viewpoint of solubility and the properties of granule. In the formula (I), EO or PO may be singly contained or EO and PO may be arranged in any form of a random copolymer and block copolymer.

Examples of the component (b) preferable from the viewpoint of solubility and the properties of a granule include glycerin, ethylene glycol, propylene glycol, 1,2,6-hexanetriol, diethylene glycol monobutyl ether and butylpropylene diglycol. Glycerin, ethylene glycol and propylene glycol are preferable and glycerin is more preferable. These polyhydric alcohols and compound represented by the formula (I) may be optionally singly or in combinations of two or more. Moreover, these compounds may be used by being diluted with water or the like from the viewpoint of production.

The component (b) used in the present invention is a compound which is liquid at room temperature (25° C.). If only a polyhydric alcohol such as sorbitol which is solid at 25° C. is selected, the effect of improving solubility is not found as shown in Comparative Example 4 which will be explained later. It is inferred that the affinity to water is improved in actual use by incorporating a material which is liquid at room temperature into granules and the rate of dissolution is also improved.

The content of the component (b) in the bleaching activator granule is preferably 0.1 to 10% by weight from the viewpoint of solubility and the properties of the granule, more preferably 0.1 to 5% by weight and even more preferably 0.2 to 2% by weight.

<Component (c)>

The bleaching activator granule of the present invention may contain, as the component (c), a nonionic surfactant from the viewpoint of solubility and the properties of the granule. Examples of the nonionic surfactant in the present invention include nonionic surfactants obtained by adding an alkylene oxide to an alcohol and particularly, nonionic surfactants represented by the following formula (3).

$$R^{3a}—O[(EO)_c/(PO)_d]-H \quad (3)$$

In the formula, $R^{3a}$ represents a hydrocarbon group having 10 to 18 carbon atoms and preferably 12 to 14 carbon atoms, and preferably, an alkyl group or an alkenyl group. EO represents an ethyleneoxy group and PO represents a propyleneoxy group. c is an average molar number and denotes a number from 0 to 20 and d is an average molar number and denotes a number from 0 to 20 excluding the case where the both are 0 simultaneously.

In the formula (3), c is preferably 6 to 15 and more preferably 7 to 12 and d is preferably 0 to 10, more preferably 1 to 5 and even more preferably 1 to 3.

In the formula (3), EO or PO may be singly formulated or EO and PO may be arranged in any form of a random copolymer and block copolymer.

The melting point of the component (c) in the present invention is preferably 30° C. or less, more preferably 25° C. or less and even more preferably 20° C. or less from the mixing aptitude of the bleaching activator granule when the granule is produced.

As to a method of measuring the melting point, the method using visual observation as described in JIS K0064-1992 (page 1 to 2) may be used to measure.

Specific examples of the nonionic surfactant in the present invention include, though not particularly limited to, Emulgen 507 (EO (7 mol) adduct of a C12/C13 mixture alcohol (melting point: 17.5° C.)) manufactured by Kao Corporation, Emulgen 109P (EO (9.2 mol) adduct of a C12 alcohol (melting point: 21° C.)) manufactured by Kao Corporation, Emulgen KS-108 (EO (5 mol)/PO (2 mol)/EO (3 mol) adduct of a C12 alcohol (melting point: −9° C.)) manufactured by Kao Corporation, Emulgen KS-110 (EO (7 mol)/PO (2 mol)/EO (3 mol) adduct of a C12/C14 mixture alcohol (melting point: 20.0° C.)) manufactured by Kao Corporation and Emulgen LS-106 (EO (2.5 mol)/PO (1.5 mol)/EO (3 mol) adduct of a C12 alcohol (melting point: −9° C.)) manufactured by Kao Corporation. Among these compounds, an EO/PO addition type nonionic surfactant is preferable from the viewpoint of solubility. Here, EO is ethylene oxide, PO is propylene oxide and the addition molar number is an average addition molar number.

The content of the component (c) in the bleaching activator granule is preferably 0.1 to 10% by weight from the viewpoint of solubility and the properties of the granule, more preferably 1 to 5% by weight and more preferably 1 to 3% by weight.

When the component (c) is used, the total content of the components (b) and (c) in the bleaching activator granule is preferably 1 to 10% by weight from the viewpoint of solubility and the properties of the granule, more preferably 2 to 7% by weight and even more preferably 2 to 5% by weight.

The ratio by weight of the component (b) to the component (c) is preferably 1.0 to 0.02 from the viewpoint of the properties of the granule and more preferably 0.7 to 0.05 based on 1 of the component (c).

<Component (d)>

The bleaching activator granule of the present invention may contain a binder material as the component (d). Any material may be used as the binder material without any particular limitation insofar as it has the ability to bind the components, constituting the bleaching activator granule, with each other. However, water and/or a water-soluble organic material is preferable from the viewpoint of the solubility of the bleaching activator granule. The melting point of the water-soluble organic material is 80° C. or less, preferably 70° C. or less and more preferably 65° C. or less from the viewpoint of mixing aptitude when the bleaching activator granule is produced. Examples of the water-soluble organic material include polyalkylene glycols (for example, polyethylene glycol and polypropylene glycol) and saturated or unsaturated fatty acids having 8 to 18 carbon atoms. These compounds may be used either singly or in combinations of two or more. Among these compounds, polyethylene glycols and polypropylene glycols are preferable and polyethylene glycols are more preferable. The average molecular weight of polyethylene glycol or polypropylene glycol is preferably 600 to 20000, more preferably 1000 to 10000 and even more preferably 2000 to 6000 from the viewpoint of improving granulation of the bleaching activator granule and mixing aptitude in manufacturing. This average molecular weight is a weight average molecular weight measured by gel permeation chromatography (eluent: 0.2 M phosphoric acid buffer solution containing 10% by weight of acrylonitrile, standard material: polyethylene glycol).

Specific examples of the polyalkylene glycol used in the present invention include, though not limited to, polypropylene glycol (average molecular weight: 2000) (melting point: 45 to 50° C.), polyethylene glycol (average molecular weight: 4000) (melting point: 50 to 58° C.) and polyethylene glycol (average molecular weight: 6000) (melting point: 55 to 62° C.).

It is particularly preferable to select an appropriate one as the water-soluble organic material such that the bleaching activator granule is solidified at 40° C. or less to exhibit binding ability from the viewpoint of preserving stability.

As to a method of measuring the melting point, the method using visual observation as described in JIS K0064-1992 (page 1 to 2) can be used to measure.

The binder material is contained in an amount of preferably 1 to 30% by weight, more preferably 5 to 25% by weight and even more preferably 7 to 20% by weight in the granule from the viewpoint of improving the granulation of the bleaching activator granule.

Moreover, the binder material is used in an amount of preferably 0.05 to 4 equivalents (weight ratio) and more preferably 0.07 to 3 equivalents to the content of powder in the bleaching activator granule.

<Other Components>

The bleaching activator granule of the present invention may be formulated with other desired components such as a bleaching base agent, an enzyme, an inorganic salt such as sodium carbonate, a surfactant other than the above component (c) and a fluorescent agent according to the need, in addition to the component (a), the component (b), the component (c) and the component (d). An example of each of the above desired components is shown below.

(1) Surfactants Other than the Component (c)

The bleaching activator granule of the present invention may contain anionic surfactants, cationic surfactants and amphoteric surfactants as the surfactants other than the above nonionic surfactant (component (c)). The bleaching activator granule of the present invention contains one or more types selected from anionic surfactants and particularly, alkyl sulfates and alkyl ether sulfates in an amount of preferably 0 to 50% by weight and more preferably 1 to 20% by weight. As the alkyl sulfate, sodium salts having 10 to 18 carbon atoms are preferable and particularly, sodium lauryl sulfate or sodium myristylsulfate is preferable. Also, as the alkyl ether sulfate, polyoxyethylene alkyl ether sulfates having 10 to 18 carbon atoms are preferable and also sodium salts are preferable. Here, the degree of polymerization of a polyoxyethylene group (POE) is an average of 1 to 10 and preferably 1 to 5, and especially sodium polyoxyethylene (POE=2 to 5 in average) lauryl ether sulfates and sodium polyoxyethylene (POE=2 to 6 in average) myristyl ether sulfate are preferable.

(2) Solid or Powdery Acid (Stabilizer)

A solid or powdery acid may be added as a stabilizer for the bleaching activator to the bleaching activator granule of the present invention. Although no particular limitation is imposed on the type of the acid, examples of the acid include formic acid, succinic acid, fumaric acid, citric acid, phosphoric acid and zeolite exhibiting solid acidity. Among these compounds, succinic acid and citric acid are preferable. These acids may each form a salt where the counter ion is an alkali metal ion, ammonium ion or the like. The content of these acids is preferably 0.5 to 10% by weight and more preferably 1 to 5% by weight in the bleaching activator granule of the present invention.

(3) Antiredeposition Agent

The bleaching activator granule of the present invention may be formulated with an antiredeposition agent prior to granulation. As the antiredeposition agent, an antiredeposition agent such as polyvinyl alcohol, polyvinyl pyrrolidone or carboxymethyl cellulose may be added according to the need though the antiredeposition agent of the present invention is not limited to these materials.

(4) Hydrotrope

The bleaching activator granule of the present invention may also be formulated with a hydrotrope prior to granulation. As the hydrotrope in this case, a hydrotrope such as urea, a urea derivative, thiouric acid, paratoluene sulfonate or a water-soluble inorganic salt may be added according to the need though the hydrotrope of the present invention is not limited to these compounds.

(5) Excipient

Inorganic salts such as Glauber's salt and zeolite may be added as an excipient for the purpose of improving granularity in the granulation. The amount of the excipient to be used is preferably 1 to 40% by weight and more preferably 5 to 20% by weight. Also, it is preferable to use an excipient having an average particle diameter of about 1 to 100 μm.

(6) Colorant

The bleaching activator granule of the present invention may be formulated with pigments and dyes as colorants for the purpose of improving its appearance and the like. As such a colorant, Phthalocyanine Green (for example, C.I. Pigment 7, 36, 37 and 38) and Ultramarine Blue (for example, C.I. Pigment Blue 29) may be used. The amount of the colorant is preferably 0.01 to 1% by weight and more preferably 0.05 to 0.5% by weight in the granule.

(7) Surface Coating Agent

The bleaching activator granule of the present invention may be subjected to surface reformation using a surface coating agent from the viewpoint of fluidity and non-caking characteristics. Examples of the surface coating agent include silicate compounds such as aluminosilicate, calcium silicate, silicon dioxide, bentonite, talc, clay, amorphous silica derivatives and crystalline silicate compounds, metal soaps, micropowders such as powdery surfactants, water-soluble polymers such as carboxymethyl cellulose, sodium polyacrylate and a copolymer of acrylic acid and maleic acid or their salts and fatty acids.

Explanations will be furnished as to a method of granulating the bleaching activator granule of the present invention.

The bleaching activator granule of the present invention may be produced by blending the components (a) and (b). Moreover, the bleaching activator granule of the present invention may be produced by blending the components (a), (b), (c) and (d). The bleaching activator granule of the present invention may be produced by melt-blending the components (a), (b), (c) and (d) and by granulating the mixture by using an extrusion granulation.

The bleaching activator granule of the present invention is preferably produced by a production method involving a process of blending a liquid product containing the component (b) with the component (a). The liquid product containing the component (b) is preferably one containing the component (b) and the component (c) and/or the component (d). The liquid product may contain a component being in a molten state by heating, and may contain components other than the components (b), (c) and (d). Specific examples of the production method include:

(i): a method in which the components (a) and (d) are simultaneously added to a liquid mixture of the components (b) and (c);

(ii): a method in which a liquid mixture of the components (b) and (c) is added to either the component (a) or (d) and the other among the components (a) and (d) is then added to the mixture.

(iii): a method in which a liquid mixture of the components (b) and (c) is added to a mixture of the components (a) and (d). Among these methods, the above method (ii) and particularly, a method in which the component (a) is first mixed with a liquid mixture of the components (b) and (c) and then the component (d) is added to the mixture is preferable.

Other specific examples of the production method include:

(1): a method in which the components (a) and (c) are simultaneously added to a liquid mixture of the components (b) and (d);

(2): a method in which a liquid mixture of the components (b) and (d) is added to either the component (a) or (c) and the other among the components (a) and (c) is added to the mixture.

(3): a method in which a liquid mixture of the components (b) and (d) is added to a mixture of the components (a) and (c).

Among these methods, particularly, a method in which a liquid mixture of the components (b) and (d) is added to a mixture of the components (a) and (c) like the above method (3) is preferable from the viewpoint of granulation of the bleaching activator granule and mixing aptitude on production.

There is no particular limitation to a granulation method and a usual granulation method using a usually known granulation device may be utilized. The granule may be produced using, for example, a stirring rolling granulation method, an extrusion granulation method or a spray cooling method. Examples of a device used for granulation include High Speed Mixer manufactured by Hukae Kogyo Co., Ltd and Proshear Mixer manufactured by pacific Machinery & Engineering Co., Ltd which are used in the stirring rolling granulation method, and Pelletter Double and Twin Dome Glan manufactured by Fuji Powdal Co., Ltd which are used in the extrusion granulation method.

As to the temperature in the granulation, the above components are preferably extruded at a temperature close to the melting point of the component (c) or (d) and more specifically, at a temperature range from a temperature higher by 20° C. to a temperature lower by 5° C. than the melting point of the component (c) or (d). At this time, an appropriate one is selected as the screen such that the granule has an average particle diameter of 700 μm to 1500 μm and the extruding pressure is adjusted that the apparent density of the granule is 0.5 to 0.8 g/mL.

Also, as other granulation methods, a granulation method using a briquetting machine to make the granule into a tablet form may be preferably exemplified.

In the present invention, the granule may be graded by cracking and globing, after the granulation, according to the need. Examples of an apparatus used for cracking include Flash Mill manufactured by Fuji Powdal Co., Ltd and Fitz Mill manufactured by Fitzpatrick Co., Ltd (USA). Examples of an apparatus using the globing include Marumeriser manufactured by Fuji Powdal Co., Ltd. As to the temperature of the granule fed to the cracking machine, the granule is preferably cooled to a temperature close to room temperature. When, for example, the granular product is cracked after fed to a vibration-cooling machine and cooled to a specified temperature, the adhesion of the cracked product in the vibration-cooling machine is limited. Also, the cracked product may be further classified to reduce a fine powder generated by the cracking and globing and a crude powder which is cracked and globed insufficiently.

Though no particular limitation is imposed on the particle diameter of the bleaching activator granule in the present invention, the average particle diameter of the granule is preferably 100 to 5000 μm and more preferably 200 to 2000 μm from the viewpoint of the appearance and solubility. The particle shape of the granule is even more preferably a sphere from the viewpoint of the appearance and classification characteristics. In the case of an extruded granular product which is not subjected to the globing, the ratio of the extrusion diameter to the length of the granule is preferably close to 1.

<Bleaching Agent Composition>

The bleaching composition of the present invention contains the above bleaching activator granule (I) and an inorganic peroxide (II) and, when it is used as a bleaching detergent composition, further contains surfactant-containing detergent particles (III).

(Inorganic Peroxide (II))

Examples of the inorganic peroxide (II) to be used in the present invention may include perborates and percarbonates. Percarbonates are particularly preferable in view of environmental safety. Also, when a perborate is used in the composition containing zeolite, a perborate coated with one type selected from paraffin, borate, perborate, ethylene oxide adduct of an alcohol, polyethylene glycol and a silicic acid compound is preferable.

(Surfactant-Containing Detergent Particles (III))

In the present invention, the bleaching agent composition may be formulated with surfactant-containing detergent particles (III) for the purpose of imparting detergency. Examples of the surfactant include anionic surfactants, nonionic surfactants, amphoteric surfactants and cationic surfactants. Specific examples of the surfactant include anionic surfactants such as an alkylbenzene sulfonate, alkyl sulfate, alkyl ether sulfate, olefin sulfonate, alkane sulfonate, fatty acid salt, alkyl or alkenyl ether carboxylate, α-sulfofatty acid salt or its ester, nonionic surfactants such as a polyoxyethylene or polyoxypropylene or its copolymer, polyoxyethylene alkyl or alkenyl ether, polyoxyethylene alkylphenyl ether, higher fatty acid alkanol amide or its alkylene oxide adduct, cane sugar fatty acid ester and alkyl glycoside, amphoteric surfactants such as amine oxide, sulfobetaine and carbobetaine and cationic surfactants such as quaternary ammonium salts. The surfactant is formulated in an amount of preferably 10 to 60% by weight and particularly preferably 20 to 50% by weight in the surfactant-containing detergent particles.

The bleaching agent composition of the present invention contains the bleaching activator granule (I) in an amount of preferably 1 to 30% by weight and more preferably 3 to 20% by weight and the inorganic peroxide (II) in an amount of 20 to 95% by weight and more preferably 30 to 90% by weight. The bleaching detergent composition in the case of formulating the surfactant-containing detergent particles (III) contains the bleaching activator granule (I) in an amount of 0.1 to 10% by weight and more preferably 0.3 to 8% by weight, the inorganic peroxide (II) in an amount of preferably 0.5 to 30% by weight and more preferably 1 to 20% by weight and the surfactant-containing detergent particles (III) in an amount of preferably 60 to 99.4% by weight and more preferably 70 to 97% by weight.

Moreover, in the present invention, the ratio (I)/(II) by weight of the bleaching activator granule (I) to the inorganic peroxide (II) is preferably 2/1 to 1/20 and more preferably 1/1 to 1/15.

In the present invention, sodium carbonate may be compounded in an amount of 1 to 50% by weight and preferably 5 to 40% by weight in the bleaching agent composition or the bleaching detergent composition. Examples of the sodium carbonate may include light ash and dense ash. Among these ashes, dense ash having an average particle diameter of 300±200 μm and preferably 300±100 μm is preferable.

In the present invention, a crystalline aluminosilicate such as A-type, X-type or P-type zeolite may be formulated in an amount of 40% by weight or less and preferably 1 to 40% by weight in the bleaching agent composition or bleaching detergent composition to improve a bleaching detergent effect. Particularly, A-type zeolite is preferable. The average primary particle diameter of zeolite is preferably 0.1 to 10 μm and more preferably 0.1 to 5 μm.

In the present invention, a sequestering agent may be compounded in an amount of 0.0005 to 30% by weight and preferably 0.01 to 15% by weight in the bleaching agent composition or bleaching detergent composition for the purpose of stabilizing an inorganic peroxide. Examples of the sequestering agent include (1) phosphoric acid type compounds such as phytic acid or their salts, (2) phosphonic acids such as ehtane-1,1-diphosphonic acid, ethane-1,1,2-triphosphonic acid, ethane-1-hydroxy-1,1-diphosphonic acid or its derivatives, ethanehydroxy-1,1,2-triphosphonic acid, ethane-1,2-dicarboxy-1,2-diphosphonic acid and methanehydroxyphosphonic acid or their salts, (3) phosphonocarboxylic acids such as 2-phosphonobutane-1,2-dicarboxylic acid, 1-phosphonobutane-2,3,4-tricarboxylic acid and α-methylphosphonosuccinic acid or their salts, (4) amino acids such as aspartic acid, glutamic acid and glycine or their salts, (5) aminopolyacetic acids such as nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraminehexaacetic acid and dienecholic acid or their salts, (6) organic acids such as diglycolic acid, oxydisuccinic acid, carboxymethyloxysuccinic acid and carboxymethyltartaric acid or their salts and (7) aminopoly(methylenephosphonic acid) or polyethylenepolyaminepoly(methylenephosphonic acid) or their salts.

Among these compounds, one or more types selected from the above (2), (5) and (6) are preferable and the above (2) and (5) are more preferable.

In the present invention, enzymes such as protease, cellulase, pectinase, amylase and lipase may be compounded in the bleaching agent composition or bleaching detergent composition with the intention of improving the bleaching effect. Particularly, one or more types of protease or cellulase may be used. Examples of the above cellulase may include bacterial cellulase and fungus cellulase. Among them, those having an optimum pH of 5 to 9.5 are preferable. For example, those described in JP-A 63-264699, page 4, right upper column, line 13 to page 5, right lower column, line 12 may be used and particularly, alkali cellulase produced from alkali-favored microorganism Bacillus SP KSM-635 (FERM BP-1485) or its mutant is preferably used. Also, cellulase described in JP-A 8-53699, fifth column, line 3 to line 21 may be used. More specific examples of the above cellulase may include enzymatic granules such as KAC500 manufactured by Kao Corporation and Celzyme® manufactured by Novo Nordisk A/S. As the above protease, alkali protease having an optimum pH of 8 or more and preferably 8 to 11 is preferable. Examples of the protease include Alkalase and Sabinase®, manufactured by Novo Nordisk A/S), Plafect®, manufactured by Jenenco Company) and KAP4.3G and KAP11.1G (manufactured by Kao Corporation). Particularly, KAP 4.3G and KAP11.1G are excellent. The enzyme is formulated in the bleaching agent composition or bleaching detergent composition in an amount of 0.005 to 3% by weight and preferably 0.01 to 2% by weight based on an enzymatic powder. When protease and cellulase are used together, the ratio by weight of protease to cellulase based on an enzymatic powder is designed to be 1/50 to 1/1 and preferably 1/30 to 1/20.

These optional components may be compounded in the bleaching agent composition or bleaching detergent composition as after-blend separately from the aforementioned bleaching activator granule (I), the inorganic peroxide (II) and/or the surfactant-containing detergent particles (III) or may be compounded in the bleaching activator granule (I)

and/or the surfactant-containing detergent particles (III). In this case, the surfactant-containing detergent particles (III) may be one containing a bleaching activator. The bleaching activator is contained in the particles in an amount of 40% by weight or less and preferably 10% by weight or less and more preferably substantially 0.

EXAMPLES

Figure 1:
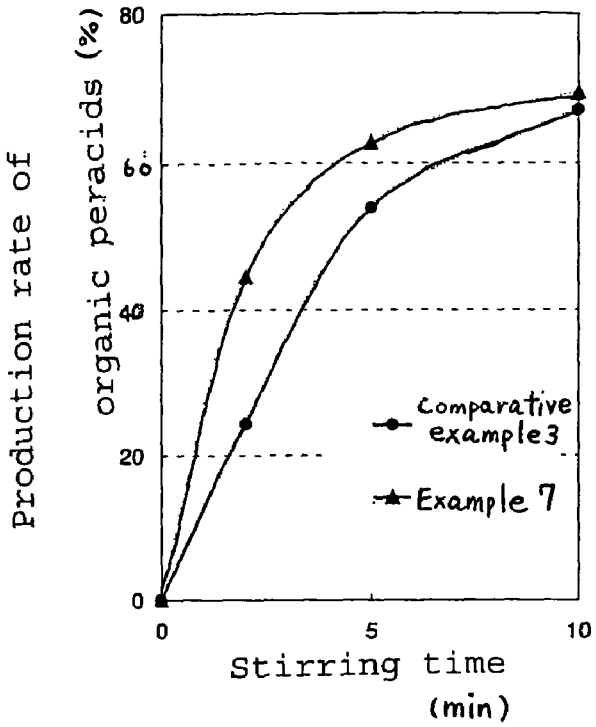
FIG. 1 is a graph showing the relationship between the stirring time and the production rate of organic peracid at 20° C. as to a bleaching activator granule obtained in Example 7 and Comparative Example 3.

The present invention will be explained in detail by way of examples, which are not intended to be limiting of the present invention. In these examples, all designations of % are on weight basis, unless otherwise noted.

Example 1

A mixer (Nauta Mixer NX-S Model, manufactured by Hosokawamicron Group) was charged with 8.45 kg of a bleaching activator (hereinafter referred to as a bleaching activator (I)) represented by the following formula (I), 0.26 kg of succinic acid (manufactured by Kawasaki Kasei Chemicals LTD) and 0.39 kg of glycerin (Japan Pharmaceutical Codex, manufactured by Kao Corporation) to mix these components with a rise in temperature in the following condition: jacket temperature: 80° C., number of self-rotations: 121 rpm and number of revolutions: 5.5 rpm. When the temperature of the powder reached 60° C., 3.9 kg of polyethylene glycol (K-PEG6000LA, manufactured by Kao Corporation) melted in advance at 70° C. was added, and the mixture was further mixed for 25 minutes and then withdrawn. Then, the obtained mixture was extruded through a screen having a pore diameter of 700 μm by using an extrusion granulator (Pelleter Double EXD-60, manufactured by Fuji Powdal) to densify the mixture. The obtained extruded material was cooled, then cracked by a sizer (Flash Mill FL200, manufactured by Fuji Powdal) and classified to adjust the particle diameter to 350 to 1410 μm, thereby obtaining a bleaching activator granule.

(I)

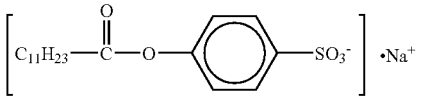

Example 2

A mixer (Nauta Mixer NX-S Model, manufactured by Hosokawamicron Group) was charged with 8.45 kg of a bleaching activator (I), 1.5 kg of an anionic surfactant (Emal 10 Powder (hereinafter referred to as E-10P), manufactured by Kao Corporation), 0.26 kg of succinic acid (manufactured by Kawasaki Kasei Chemicals LTD) and 0.59 kg of glycerin (Japan Pharmaceutical Codex, manufactured by Kao Corporation) to mix these components with a rise in temperature in the following condition: jacket temperature: 80° C., number of self-rotations: 121 rpm and number of revolutions: 5.5 rpm. When the temperature of the powder reached 60° C., 2.21 kg of polyethylene glycol (K-PEG6000LA, manufactured by Kao Corporation) melted in advance at 70° C. was added, and the mixture was further mixed for 25 minutes and then withdrawn. Then, the obtained mixture was extruded through a screen having a pore diameter of 700 μm by using an extrusion granulator (Pelleter Double EXD-60, manufactured by Fuji Powdal) to densify the mixture. The obtained extruded material was cooled, then cracked by a sizer (Flash Mill FL200, manufactured by Fuji Powdal) and classified to adjust the particle diameter to 350 to 1410 μm, thereby obtaining a bleaching activator granule.

Example 3

A mixer (Nauta Mixer NX-S Model, manufactured by Hosokawamicron Group) was charged with a pre-mixture of 0.65 kg of a nonionic surfactant (Emulgen KS108S95) and 0.39 kg of glycerin (Japan Pharmaceutical Codex, manufactured by Kao Corporation), 8.45 kg of a bleaching activator (I) and 0.26 kg of succinic acid (manufactured by Kawasaki Kasei Chemicals LTD) to mix these components with a rise in temperature in the following condition: jacket temperature: 80° C., number of self-rotations: 121 rpm and number of revolutions: 5.5 rpm. When the temperature of the powder reached 60° C., 3.25 kg of polyethylene glycol (K-PEG6000LA, manufactured by Kao Corporation) melted in advance at 70° C. was added, and the mixture was further mixed for 25 minutes and then withdrawn. Then, the obtained mixture was extruded through a screen having a pore diameter of 700 μm by using an extrusion granulator (Pelleter Double EXD-60, manufactured by Fuji Powdal) to densify the mixture. The obtained extruded material was cooled, then cracked by a sizer (Flash Mill FL200, manufactured by Fuji Powdal) and classified to adjust the particle diameter to 350 to 1410 μm, thereby obtaining a bleaching activator granule.

Example 4

A mixer (Nauta Mixer NX-S Model, manufactured by Hosokawamicron Group) was charged with a pre-mixture of 0.33 kg of a nonionic surfactant (Emulgen KS108S95) and 0.13 kg of glycerin (Japan Pharmaceutical Codex, manufactured by Kao Corporation), 9.49 kg of a bleaching activator (I), 1.50 kg of an anionic surfactant (E-10P, manufactured by Kao Corporation) and 0.26 kg of succinic acid (manufactured by Kawasaki Kasei Chemicals LTD) to mix these components with a rise in temperature in the following condition: jacket temperature: 80° C., number of self-rotations: 121 rpm and number of revolutions: 5.5 rpm. When the temperature of the powder reached 60° C., 1.3 kg of polyethylene glycol (K-PEG6000LA, manufactured by Kao Corporation) melted in advance at 70° C. was added, and the mixture was further mixed for 25 minutes and then withdrawn. Then, the obtained mixture was extruded through a screen having a pore diameter of 700 μm by using an extrusion granulator (Pelleter Double EXD-60, manufactured by Fuji Powdal) to densify the mixture. The obtained extruded material was cooled, then cracked by a sizer (Flash Mill FL1200, manufactured by Fuji Powdal) and classified to adjust the particle diameter to 350 to 1410 μm, thereby obtaining a bleaching activator granule.

Example 5

A granule was produced in the same condition as in Example 4 except that the amount of glycerin (Japan Pharmaceutical Codex, manufactured by Kao Corporation) was altered to 0.26 kg, the amount of the nonionic surfactant (Emulgen KS108S95, manufactured by Kao Corporation) was altered to 0.26 kg and the amount of polyethylene glycol (K-PEG6000LA, manufactured by Kao Corporation) was altered to 1.24 kg.

Example 6

A granule was produced in the same condition as in Example 4 except that the amount of glycerin (Japan Pharmaceutical Codex, manufactured by Kao Corporation) was altered to 0.026 kg, the amount of the nonionic surfactant (Emulgen KS108S95, manufactured by Kao Corporation) was altered to 0.65 kg and the amount of polyethylene glycol (K-PEG6000LA, manufactured by Kao Corporation) was altered to 1.08 kg.

Example 7

A granule was produced in the same condition as in Example 4 except that the amount of the bleaching activator (I) was altered to 9.1 kg, the amount of glycerin (Japan Pharmaceutical Codex, manufactured by Kao Corporation) was altered to 0.26 kg, the amount of the anionic surfactant (E-10P, manufactured by Kao Corporation) was altered to 1.69 kg, the amount of succinic acid (manufactured by Kawasaki Kasei Chemicals LTD) was altered to 0.39 kg, the amount of polyethylene glycol (K-PEG6000LA, manufactured by Kao Corporation) was altered to 1.17 kg, the nonionic surfactant was changed to Emulgen KS110S95 manufactured by Kao Corporation from Emulgen KS108S95 manufactured by Kao Corporation wherein this nonionic surfactant (Emulgen KS110S95 manufactured by Kao Corporation) was formulated in an amount of 0.39 kg.

Example 8

A granule was produced in the same condition as in Example 7 except that 0.26 kg of diethylene glycol monobutyl ether was used instead of glycerin.

Example 9

A granule was produced in the same condition as in Example 7 except that 0.26 kg of ethylene glycol was used instead of glycerin.

Example 10

A granule was produced in the same condition as in Example 7 except that 0.26 kg of propylene glycol was used instead of glycerin.

Example 11

A granule was produced in the same condition as in Example 4 except that the amount of the bleaching activator (I) was altered to 9.75 kg, the amount of glycerin (Japan Pharmaceutical Codex, manufactured by Kao Corporation) was altered to 0.065 kg, the amount of the nonionic surfactant (Emulgen KS108S95, manufactured by Kao Corporation) was altered to 0.46 kg, the amount of the anionic surfactant (E-10P, manufactured by Kao Corporation) was altered to 1.43 kg and the amount of polyethylene glycol (K-PEG6000LA, manufactured by Kao Corporation) was altered to 1.04 kg.

Example 12

A granule was produced in the same condition as in Example 7 except that 9.1 kg of tetraacetylethylenediamine was formulated instead of the bleaching activator (I).

Comparative Example 1

A mixer (Nauta Mixer NX-S Model, manufactured by Hosokawamicron Group) was charged with 8.45 kg of a bleaching activator (I) and 0.26 kg of succinic acid (manufactured by Kawasaki Kasei Chemicals LTD) to mix these components with a rise in temperature in the following condition: jacket temperature: 80° C., number of self-rotations: 121 rpm and number of revolutions: 5.5 rpm. When the temperature of the powder reached 60° C., 4.29 kg of polyethylene glycol (K-PEG6000LA, manufactured by Kao Corporation) melted in advance at 70° C. was added, and the mixture was further mixed for 25 minutes and then withdrawn. Then, the obtained mixture was extruded through a screen having a pore diameter of 700 μm by using an extrusion granulator (Pelleter Double EXD-60, manufactured by Fuji Powdal) to densify the mixture. The obtained extruded material was cooled, then cracked by a sizer (Flash Mill FL200, manufactured by Fuji Powdal) and classified to adjust the particle diameter to 350 to 1410 μm, thereby obtaining a bleaching activator granule.

Comparative Example 2

A mixer (Nauta Mixer NX-S Model, manufactured by Hosokawamicron Group) was charged with 9.49 kg of a bleaching activator (I), 1.24 kg of an anionic surfactant (E-10P, manufactured by Kao Corporation) and 0.26 kg of succinic acid (manufactured by Kawasaki Kasei Chemicals LTD) to mix these components with a rise in temperature in the following condition: jacket temperature: 80° C., number of self-rotations: 121 rpm and number of revolutions: 5.5 rpm. When the temperature of the powder reached 60° C., 2.02 kg of polyethylene glycol (K-PEG6000LA, manufactured by Kao Corporation) melted in advance at 70° C. was added, and the mixture was further mixed for 25 minutes and then withdrawn. Then, the obtained mixture was extruded through a screen having a pore diameter of 700 μm by using an extrusion granulator (Pelleter Double EXD-60, manufactured by Fuji Powdal) to densify the mixture. The obtained extruded material was cooled, then cracked by a sizer (Flash Mill FL200, manufactured by Fuji Powdal) and classified to adjust the particle diameter to 350 to 1410 μm, thereby obtaining a bleaching activator granule.

Comparative Example 3

A granule was produced in the same condition as in Example 7 except that the amount of polyethylene glycol (K-PEG6000LA, manufactured by Kao Corporation) was altered to 1.43 kg and no glycerin was formulated.

Comparative Example 4

A granule was produced in the same condition as in Example 7 except that 0.26 kg of sorbitol was formulated instead of glycerin.

Comparative Example 5

A granule was produced in the same condition as in Example 11 except that the amount of the nonionic surfactant (Emulgen KS108S95, manufactured by Kao Corporation) was altered to 0.52 kg and no glycerin was formulated.

Comparative Example 6

A granule was produced in the same condition as in Example 12 except that the amount of polyethylene glycol (K-PEG6000LA, manufactured by Kao Corporation) was altered to 1.43 kg and no glycerin was formulated.

The dissolution time and caking characteristics of each bleaching activator granule obtained in the examples and comparative examples are shown in Tables 1 to 6. With regard to a part of the granules, the production rate of organic peracids was also measured. These characteristics were evaluated according to the following methods.

<Dissolution Time>

Using ion exchange water kept at a temperature of 20° C. or 10° C., each bleaching activator granule obtained in the examples and comparative examples was added in an amount of 7% by weight to the above water and these components were mixed with stirring (stirrer piece: length: 30 mm, diameter: 5 mm and number of rotations: 350 rpm) using a magnetic stirrer to measure a change in the electroconductivity of the ion exchange water with time by a conductometric device. After confirming that the bleaching activator left undissolved was not observed, the dissolution rate (%) was calculated by the following equation to show the time required to dissolve 90% (weight basis) of the granule as T-90 dissolution time.

Dissolution rate (%)=(Electroconductivity/Maximum value of the electroconductivity)×100

<Caking Characteristics>

120 g of each bleaching activator granule obtained in the examples and comparative examples was placed in a 10-cm-long, 6-cm-wide and 4-cm high paper box with a 9.5-cm-long and 5.5-cm-wide acryl plate lid resting directly on the granule. A 250 g weight was placed on this lid and the paper box was stored in a circumstance of 30° C./50% Rh for 4 days. After that, the weight and the acryl plate were removed and the level of solidification of the bleaching activator granule was rated by visual observation and by the feel according to the following standard.

I: Almost no solid is observed.

II: Though a little solid is generated, the solid is crushed and returned to a granular state when giving a light touch.

III: Much solid is generated.

IV: Wholly solidified, posing a handling problem.

<Method of Measuring the Production Rate of Organic Peracids>

Figure 2:
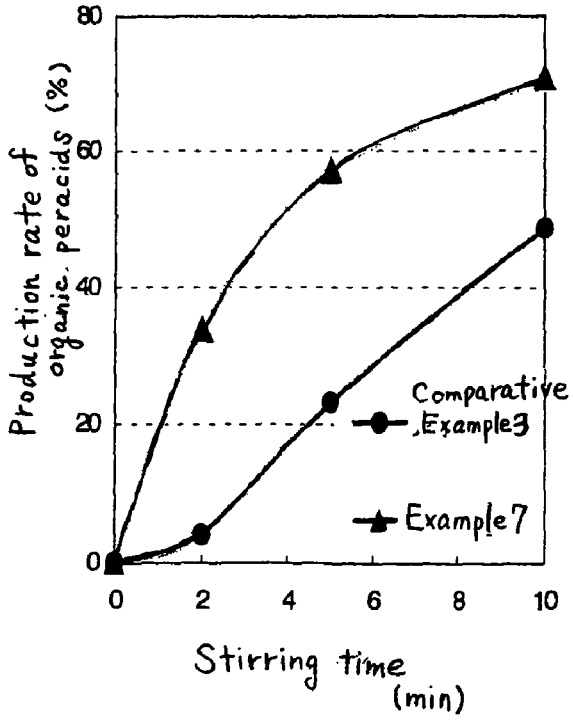
FIG. 2 is a graph showing the relationship between the stirring time and the production rate of organic peracid at 10° C. as to a bleaching activator granule obtained in Example 7 and Comparative Example 3.

An aqueous solution was prepared as follows: 1 L of ion exchange water was poured into a 1 L beaker, to which 3 ml of an aqueous 5 wt % LAS (sodium dodecylbenzenesulfonate) solution, 3 ml of an aqueous 5 wt % sodium carbonate solution and 10 ml of an aqueous 0.2 wt % hydrogen peroxide solution were added. The obtained aqueous solution was stirred (100 rpm) by a magnetic stirrer (using a cylindrical stirrer piece having a diameter of 10 mm and a length of 30 mm) for one minute. Then, 0.05 g of each bleaching activator granule obtained in the examples and comparative examples was added to the aqueous solution, which was then stirred for given times (2 minutes, 5 minutes and 10 minutes). 10 ml of an aqueous 0.36 catalase solution was added to the solution, which was further stirred for one minute. 10 ml of a 10 wt % potassium iodide solution and 20 ml of a 20 wt % sulfuric acid solution were added to this solution. Then, the resulting solution was titrated using a 0.02 mol/l sodium thiosulfate solution to calculate the production rate of organic peracids based on the following equation. The results are shown in FIGS. 1 and 2 and Table 6.

Production rate of organic peracids (%)={(0.02 (mol/l)×(titer of a sodium thiosulfate solution (ml)/1000)×0.5)/(Bleaching activator effective content (g)/Molecular weight of the bleaching activator)}×100

In the formula, the bleaching activator effective content is a weight (g) of the bleaching activator in the bleaching activator granule. When the bleaching activator is tetraacetylethylenediamine, bimolecular organic peracids can be produced more easily than monomolecular peracids, two equivalents (g) to the weight of the bleaching activator in the bleaching activator granule is defined as the effective content of the bleaching activator.

TABLE 1

| | | | Example 1 | Example 2 | Example 3 | Comparative Example 1 |
|---|---|---|---|---|---|---|
| Composition (weight-%) | Bleaching activator | Sodium dodecanoyloxybenzenesulfonate | 65 | 65 | 65 | 65 |
| | Polyhydric alcohol which is liquid at room temperature | Japan Pharmaceutical Codex glycerin | 3 | 4.5 | 3 | — |
| | Nonionic surfactant | Emulgen KS108S95 | — | — | 5 | — |
| | Anionic surfactant | E-10P | — | 11.5 | — | — |
| | Stabilizer | Succinic acid | 2 | 2 | 2 | 2 |
| | Binder | K-PEG6000LA | 30 | 17 | 25 | 33 |
| T-90 dissolution time (20° C.) | | (sec) | 83 | 71 | 57 | 863 |
| T-90 dissolution time (10° C.) | | (sec) | 190 | 146 | 110 | 2360 |

TABLE 2

| | | | Example 4 | Example 5 | Example 6 | Comparative example 2 |
|---|---|---|---|---|---|---|
| Composition (weight-%) | Bleaching activator | Sodium dodecanoyloxybenzenesulfonate | 73 | 73 | 73 | 73 |
| | Polyhydric alcohol which is liquid at room temperature | Japan Pharmaceutical Codex glycerin | 1 | 2 | 0.2 | — |

TABLE 2-continued

| | | | Example 4 | Example 5 | Example 6 | Comparative example 2 |
|---|---|---|---|---|---|---|
| | Nonionic surfactant | Emulgen KS108S95 | 2.5 | 2 | 5 | — |
| | Cationic surfactant | E-10P | 11.5 | 11.5 | 11.5 | 9.5 |
| | Stabilizer | Succinic acid | 2 | 2 | 2 | 2 |
| | Binder | K-PEG6000LA | 10 | 9.5 | 8.3 | 15.5 |
| T-90 dissolution time (20° C.) | | (sec) | 56 | 48 | 58 | 525 |
| T-90 dissolution time (10° C.) | | (sec) | 98 | 76 | 99 | 1522 |
| Caking characterstics | | | I | II | II | I |

TABLE 3

| | | | Example 7 | Example 8 | Comparative example 3 | Comparative example 4 |
|---|---|---|---|---|---|---|
| Composition (weight-%) | Bleaching activator | Sodium dodecanoyloxybenzenesulfonate | 70 | 70 | 70 | 70 |
| | Alcohol which is liquid at room temperature | Japan Pharmaceutical Codex glycerin | 2 | — | — | — |
| | | Diethylene glycol monobutyl ether | — | 2 | | |
| | Alcohol which is a solid at room temperature | Sorbitol | — | — | — | 2 |
| | Nonionic surfactant | Amulgen KS110S95 | 3 | 3 | 3 | 3 |
| | Cationic surfactant | E-10P | 13 | 13 | 13 | 13 |
| | Stabilizer | Succinic acid | 3 | 3 | 3 | 3 |
| | Binder | K-PEG6000LA | 9 | 9 | 11 | 9 |
| T-90 dissolution time (20° C.) | | (sec) | 52 | 75 | 99 | 99 |
| T-90 dissolution time (10° C.) | | (sec) | 120 | 152 | 233 | 230 |

TABLE 4

| | | | Example 7 | Example 9 | Example 10 |
|---|---|---|---|---|---|
| Composition (weight-%) | Bleaching activator | Sodium dodecanoyloxybenzenesulfonate | 70 | 70 | 70 |
| | Polyhydric alcohol which is liquid at room temperature | Japan Pharmaceutical Codex glycerin | 2 | — | — |
| | | Ethylene glycol | — | 2 | — |
| | | Propylene glycol | — | — | 2 |
| | Nonionic surfactant | Emulgen KS110S95 | 3 | 3 | 3 |
| | Cationic surfactant | E-10P | 13 | 13 | 13 |
| | Stabilizer | Succinic acid | 3 | 3 | 3 |
| | Binder | K-PEG6000LA | 9 | 9 | 9 |
| T-90 dissolution time (20° C.) | | (sec) | 52 | 52 | 57 |

TABLE 5

| | | | Example 11 | Comparative example 5 |
|---|---|---|---|---|
| Composition (weight-%) | Bleaching activator | Sodium dodecanoyloxybenzene-sulfonate | 75 | 75 |
| | Polyhydric alcohol which is liquid at room temperature | Japan Pharmaceutical Codex glycerin | 0.5 | — |
| | Noninic surfactant | Emulgen KS108S95 | 3.5 | 4 |
| | Anionic surfactant | E-10P | 11 | 11 |
| | Stabilizer | Succinic acid | 2 | 2 |
| | Binder | K-PEG6000LA | 8 | 8 |
| T-90 dissolution time (20° C.) | | (sec) | 73 | 122 |
| T-90 dissolution time (10° C.) | | (sec) | 176 | 265 |

TABLE 6

| | | | Example 12 | Comparative example 6 |
|---|---|---|---|---|
| Composition (weight-%) | B; eacing activator | Tetraacetylethylenediamine | 70 | 70 |
| | Alcohol which is liquid at room temperature | Japan Pharmaceutical Codex glycerin | 2 | — |
| | Noninic surfactant | Emulgen KS110S95 | 3 | 3 |
| | Anionic surfactant | E-10P | 13 | 13 |
| | Stabilizer | Succinic acid | 3 | 3 |
| | Binder | K-PEG6000LA | 9 | 11 |
| T-90 dissolution time (sec) (10° C.) | | | 38 | 50 |
| Production rate of organic peracids (10° C., stirring, 5 minutes) | | | 64 | 40 |

Examples 13 to 16 and Comparative Examples 7 and 8

Bleaching agent compositions and bleaching detergent compositions were prepared using a part of the bleaching activators obtained in the above Examples 1 to 12 and Comparative Examples 1 to 6 and evaluated as follows. The components used for the preparation of each composition are as follows.

(1) Inorganic Peracids

Sodium percarbonate (5% coated) coated with sodium methaborate tetrahydrate based on Example 1 described in the publication of JP-A No. 59-196399. As the sodium percarbonate, one manufactured by Nippon Peroxide Company was used.

(2) Surfactant-Containing Detergent Particles

Surfactant-containing detergent particles obtained in the following manner. Specifically, a water slurry having a solid content of 50% was produced from 2000 g of sodium straight-chain alkyl (12 carbon atoms) benzenesulfonate, 500 g of sodium laurylsulfate, 300 g of polyoxyethylene alkyl ether (Emulgen 510L, manufactured by Nippon Shokubai Co., Ltd.), 300 g of acrylic acid/maleic acid copolymer (Socalan cp-5, manufactured by BASF), 300 g of a sodium tallow fatty acid salt, 600 g of sodium carbonate, 1500 g of No. 1 silicate, 1500 g of 4A type zeolite, the balance amount of Glauber's salt and 100 g of PEG (weight average molecular weight: 13000). Particles obtained by spray-drying (drying temperature: 190° C.) the water slurry was placed in a high-speed mixer (FS-GC-10 Model, manufactured by Fukae Kogyo), to which 500 g of polyoxyethylene lauryl ether (EO average molar number: 8) and 1500 g of 4A type zeolite and the resulting mixture was granulated. Average particle diameter: 430 μm and bulk density: 780 g/L.

(3) Other Components

Alkali protease: KAP 4.3G, manufactured by Kao Corporation

Sodium carbonate: manufactured by Central Glass Co., Ltd.

Sodium sulfate: manufactured by Shikoku Chemicals Corporation

The bleaching agent composition shown in the following Table 7 is one containing a bleaching activator granule and an inorganic peroxide and the bleaching detergent composition shown in Table 8 is one containing a bleaching activator granule, an inorganic peroxide and surfactant-containing detergent particles. With regard to the bleaching agent composition shown in Table 7 and the bleaching detergent composition shown in Table 8, the production rate of organic peracids and bleaching performance (dipping condition and washing condition) of each composition were evaluated in the following methods.

<Bleaching Performance (1): Dipping Condition>

Each bleaching agent composition was dissolved in 500 ml of city water at 10° C. such that the concentration of the bleaching activator was 0.05% by weight and 5 clothes contaminated with curry (lipophilic soil) prepared in the following manner were dipped in each solution for 30 minutes. Then, these clothes were rinsed with city water and dried to calculate the bleaching rate by the following equation.

$$\text{Bleaching rate (\%)}=\{(\text{Reflectance after bleaching}-\text{Reflectance before bleaching})/(\text{Reflectance of a white cloth}-\text{Reflectance before bleaching})\}\times 100$$

The reflectance was measured by NDR-10DP manufactured by Nippon Denshoku Industries Co., Ltd. using a 460 nm filter.

(Preparation of Clothes Contaminated with Curry)

The solid component of a retort curry (Curry Marshe) manufactured by House Food Industrial Co., Ltd. was removed by a mesh and then, the obtained solution was heated until the solution was boiled. A cotton gold cloth #2003 was dipped in this solution and boiled for about 15 minutes. The solution was taken off from the fire as it was and allowed to stand until the temperature was dropped to ambient temperature for about 2 hours. Then, the clothes were taken out to remove the curry solution stuck excessively to the clothes by a spatula and then dried in air. Then, the clothes were pressed into a test piece of 10 cm×10 cm, which was then subjected to a test.

<Bleaching Performance (2): Washing Condition>

The bleaching detergent composition was dissolved in 1 L of city water at 10° C. such that the concentration of the bleaching activator was 0.003% by weight and 5 clothes contaminated with curry (lipophilic soil) prepared in the above manner were dipped in the above city water to carry out washing by Terg-O-Tometer at 100 rpm. The washing was carried out in the following washing condition: washing time: 10 minutes, hardness: 4° DH, water temperature: 10° C. and rinsing: carried out using city water for 5 minutes. The bleaching rate was calculated in the same method as above.

<Method of Measuring the Production Rate of Organic Peracids>

An aqueous solution prepared by pouring 1 L of ion exchange water into a 1 L beaker, to which 3 ml of an aqueous 5 wt % LAS (sodium dodecylbenzenesulfonate) solution and 3 ml of an aqueous 5 wt % sodium carbonate solution were added was stirred (100 rpm) by a magnetic stirrer (using a cylindrical stirrer piece having a diameter of 10 mm and a length of 30 mm) for one minute. Then, the bleaching composition obtained in the examples or comparative examples was added to the above mixture such that the amount of the bleaching activator granule was 0.05 g. The resulting solution was stirred for 5 minutes and 10 ml of an aqueous 0.3% catalase solution was added to the solution, which was further stirred for one minute. 10 ml of a 10 wt % potassium iodide solution and 20 ml of a 20 wt % sulfuric acid solution were added to this solution. Then, the resulting solution was titrated using a 0.02 mol/l sodium thiosulfate solution to calculate the production rate of organic peracids based on the following equation.

Production rate of organic peracids (%)=[(0.02 (mol/l)×(titer of a sodium thiosulfate solution (ml)/1000)×0.5)/{(Bleaching activator effective content (g)/Molecular weight of the bleaching activator)}]×100

In the formula, the bleaching activator effective content is a weight (g) of the bleaching activator in the bleaching activator granule.

TABLE 7

| Bleaching agent composition | | | Example 13 | Example 14 | Comparative example 7 |
|---|---|---|---|---|---|
| Composition (weight-%) | Bleaching activator granule | Example 4 | 10 | | |
| | | Example 7 | | 10 | |
| | | Comparative example 3 | | | 10 |
| | Inorganic peroxide | | 80 | 80 | 80 |
| | Alkali protease | | 1 | 1 | 1 |
| | Sodium carbonate | | 9 | 9 | 9 |
| Production rate of organic peracids (%) [20° C., stirring, 5 minutes] | | | 54 | 60 | 38 |
| Bleaching rate (%) [dipping condition] | | | 50 | 58 | 36 |

TABLE 8

| | | | Example 15 | Example 16 | Comparative example 8 |
|---|---|---|---|---|---|
| Composition (weight-%) | Bleaching activator granule | Example 4 | 5 | | |
| | | Example 7 | | 5 | |
| | | Comparative example 3 | | | 5 |
| | peroxide | | 10 | 10 | 10 |
| | Surfactant-containing particles | | 74 | 74 | 74 |
| | Alkali protease | | 1 | 1 | 1 |
| | Sodium sulfate | | 10 | 10 | 10 |
| Bleaching rate(%) [washing condition] | | | 45 | 49 | 35 |

A difference in the content of the bleaching activator in the granule causes a change in the dissolution time. Therefore, it is necessary to compare granules containing the bleaching activator at a constant content in the above examples and comparative examples.

From the comparison between the dissolution times of Example 1 and Comparative Example 1 in Table 1, it is understood that the solubility of the granule is improved by formulating a specified compound which is liquid at room temperature (25° C.) as the component (b). Also, from the comparison between Examples 4 to 6 and Comparative Example 2 in Table 2, it is found that the solubility is further improved by combining a nonionic surfactant which is the component (c).

From the results of measurement of the production rate of organic peracids shown in FIGS. 1 and 2, it is found that the bleaching activator granule of Example 7 containing the components (b) and (c) is more increased in the production rate of organic peracids than the bleaching activator granule of Comparative Example 3. Also, from the results of the evaluation of the bleaching performance shown in Table 7, it is found that the bleaching activator granule of Example 7 has higher bleaching ability than the bleaching activator granule of Comparative Example 3. It is inferred from these results that the bleaching activator granule of the present invention is improved in solubility, resulting in an increase in the production speed of the organic peracids contributing to the bleaching of clothes, bringing about improved bleaching ability.

Also, the bleaching activator granule of the present invention is significantly improved in solubility at low temperatures, is improved in bleaching performance and can be reduced in the amount of the bleaching activator granule left undissolved.

The invention claimed is:

1. A bleaching activator granule comprising 50 to 90 wt. % of a component (a): selected from the group consisting of sodium dodecanoyloxybenzenesulfonate, sodium nonanoyl oxybenzene sulfonate, iso-nonanoyl oxybenzene carboxylic acid, and decanoyl oxybenzene carboxylic acid, 0.1 to 5 wt. % of a component (b): one or more polyhydric alcohols selected from the group consisting of ethylene glycol, glycerin and propylene glycol, and 2 to 5 wt. % of a component (c): a nonionic surfactant represented by the following formula (3):

$R^{3a}$—O[(EO)$_c$/(PO)$_d$]-H (3)

wherein $R^{3a}$ represents a hydrocarbon group having 10 to 18 carbon atoms, EO represents an ethyleneoxy group and PO represents a propyleneoxy group, and c denotes a number from 6 to 15 and d denotes a number from 0 to 5.

2. A bleaching activator granule according to claim 1, the granule further comprising (d) a component: a binder material.

3. A bleaching activator granule according to claim 2, the binder material which is the component (d) is a polyalkylene glycol.

4. A bleaching activator granule according to claim 2, wherein the weight average molecular weight of the component (d) is 600 to 20000.

5. A bleaching activator granule according to claim 2, the granule containing 1 to 30% by weight of the component (d).

6. A bleaching activator granule according to claim 2, wherein the component (c) has a melting point of 30° C. or less and the component (d) has a melting point of 80° C. or less.

7. A bleaching agent composition comprising the bleaching activator granule as claimed in claim 1 and an inorganic peroxide.

8. A bleaching agent composition according to claim 7, the composition further comprising surfactant-containing detergent particles.

9. A method of producing the bleaching activator granule according to claim 1 comprising a process of mixing a liquid product containing the component (b) and the component (c) with the component (a).

10. The method according to claim 9, wherein the liquid product containing the component (b) and the component (c) optionally contains a component (d) a binder material.

11. A bleaching activator granule comprising 50 to 90 wt. % of a component (a): selected from the group consisting of an alkanoyl oxybenzenecarboxylic acid wherein the number of carbons in the alkanoyl group is 9 to 10 and a sodium alkanoyl oxybenzenesulfonate wherein the number of carbons in the alkanoyl group is 9 to 12 , 0.1 to 5 wt. % of a component (b): one or more polyhydric alcohols selected from the group consisting of ethylene glycol, glycerin and propylene glycol, and 2 to 5 wt. % of a component (c): a nonionic surfactant represented by the following formula (3):

$R^{3a}$—O[(EO)$_c$/(PO)$_d$]-H (3)

wherein $R^{3a}$ represents a hydrocarbon group having 10 to 18 carbon atoms, EO represents an ethyleneoxy group and PO represents a propyleneoxy group, and c denotes a number from 6 to 15 and d denotes a number from 0 to 5.

12. A bleaching activator granule according to claim 11, the granule further comprising (d) a component: a binder material.

13. A bleaching activator granule according to claim 12, the binder material which is the component (d) is a polyalkylene glycol.

14. A bleaching activator granule according to claim 12, wherein the weight average molecular weight of the component (d) is 600 to 20000.

15. A bleaching activator granule according to claim 12, the granule containing 1 to 30% by weight of the component (d).

16. A bleaching activator granule according to claim 12, wherein the component (c) has a melting point of 30° C. or less and the component (d) has a melting point of 80° C. or less.

* * * * *